US009200784B2

(12) United States Patent
Mandy et al.

(10) Patent No.: US 9,200,784 B2
(45) Date of Patent: Dec. 1, 2015

(54) DOWNWARD ILLUMINATION ASSEMBLY

(71) Applicant: Man-D-Tec, Inc., Scottsdale, AZ (US)

(72) Inventors: Dalton J. Mandy, Scottsdale, AZ (US); Terry R. Mandy, Paradise Valley, AZ (US); Brandon R. Mandy, Scottsdale, AZ (US)

(73) Assignee: MAN-D-TEC, INC., Scottsdale, AZ (US)

( * ) Notice: Subject to any disclaimer, the term of this patent is extended or adjusted under 35 U.S.C. 154(b) by 108 days.

(21) Appl. No.: 14/217,250

(22) Filed: Mar. 17, 2014

(65) Prior Publication Data

US 2014/0268823 A1 Sep. 18, 2014

Related U.S. Application Data

(60) Provisional application No. 61/787,387, filed on Mar. 15, 2013.

(51) Int. Cl.
*F21S 8/02* (2006.01)
*F21V 19/00* (2006.01)
(Continued)

(52) U.S. Cl.
CPC ..... *F21V 19/0015* (2013.01); *F21K 9/30* (2013.01); *F21K 9/90* (2013.01); *F21S 8/026* (2013.01); *F21V 17/002* (2013.01); *F21V 17/12* (2013.01); *B66B 11/0233* (2013.01); *F21Y 2101/02* (2013.01); *Y10T 29/49002* (2015.01)

(58) Field of Classification Search
CPC ..... F21S 8/02; F21S 8/026; F21V 19/0055; F21K 9/30; B66B 11/0233
USPC ..... 362/364
See application file for complete search history.

(56) References Cited

U.S. PATENT DOCUMENTS 1,767,988 A 6/1930 Knapp
2,835,791 A 5/1958 Horwitz
(Continued)

FOREIGN PATENT DOCUMENTS

EP 0495273 A1 7/1992
WO 03019073 A1 3/2003
(Continued)

OTHER PUBLICATIONS

Installation guide for IP110-F Flush Mount Adapter, Pelco, Inc., Dec. 2008, C2238M, 8 pages.
(Continued)

*Primary Examiner* — Robert May
(74) *Attorney, Agent, or Firm* — Reising Ethington P.C.

(57) ABSTRACT

An illumination assembly comprising an LED module removably supported within a lamp housing configured to be mounted on an elevator ceiling panel in a position to direct light from the LED module downward into an elevator passenger compartment through an opening in the housing and a hole in the ceiling panel. The LED module is removable from the housing from below the ceiling panel through the housing opening and the hole in the ceiling panel. Threads formed in an inner cylindrical wall of the lamp housing receive threads formed in an outer circumferential surface of the LED module in threaded engagement. The LED module includes at least two LED module removal surfaces positioned to be engaged by respective engagement surfaces of a tool configured to apply torque to and rotate the LED module relative to the lamp housing.

14 Claims, 4 Drawing Sheets

(51) Int. Cl.

| | |
|---|---|
| ***F21K 99/00*** | (2010.01) |
| ***F21V 17/00*** | (2006.01) |
| ***F21V 17/12*** | (2006.01) |
| *B66B 11/02* | (2006.01) |
| *F21Y 101/02* | (2006.01) |

(56) References Cited

U.S. PATENT DOCUMENTS

| | | | |
|---|---|---|---|
| 3,189,788 | A | 6/1965 | Cady |
| 3,294,977 | A | 12/1966 | Duncan |
| 3,336,473 | A | 8/1967 | Buzan |
| 3,760,179 | A | 9/1973 | Addington, Jr. |
| 3,808,499 | A | 4/1974 | Edwards |
| 4,013,993 | A | 3/1977 | Mandel et al. |
| 4,032,828 | A | 6/1977 | Strobl et al. |
| 4,039,822 | A | 8/1977 | Chan et al. |
| 4,056,757 | A | 11/1977 | Mauch et al. |
| 4,071,749 | A | 1/1978 | Balogh |
| 4,156,891 | A | 5/1979 | Roche |
| 4,218,725 | A | 8/1980 | Heffner et al. |
| 4,223,232 | A | 9/1980 | Bulat |
| 4,234,907 | A | 11/1980 | Daniel |
| 4,241,871 | A | 12/1980 | Newell, III et al. |
| 4,271,621 | A | 6/1981 | Garcia et al. |
| 4,441,143 | A | 4/1984 | Richardson, Jr. |
| 4,504,894 | A | 3/1985 | Reibling |
| 4,520,436 | A | 5/1985 | McNair et al. |
| 4,587,597 | A | 5/1986 | Meyers |
| 4,682,078 | A | 7/1987 | Pascilade |
| 4,697,890 | A | 10/1987 | Crookston et al. |
| 4,708,223 | A | 11/1987 | Omdorff et al. |
| 4,727,291 | A | 2/1988 | Bavaria |
| 4,749,908 | A | 6/1988 | Sifter |
| 4,751,398 | A | 6/1988 | Ertz, III |
| 4,802,065 | A | 1/1989 | Minter et al. |
| 4,875,553 | A | 10/1989 | Smith et al. |
| 4,885,663 | A | 12/1989 | Parker |
| 4,890,200 | A | 12/1989 | Mandy |
| 4,905,579 | A | 3/1990 | Dame |
| 4,907,132 | A | 3/1990 | Parker |
| 4,947,291 | A | 8/1990 | McDermott |
| 4,977,818 | A | 12/1990 | Taylor et al. |
| 5,003,432 | A | 3/1991 | Mandy |
| 5,005,108 | A | 4/1991 | Pristash et al. |
| 5,021,928 | A | 6/1991 | Daniel |
| 5,025,349 | A | 6/1991 | Gow |
| 5,123,875 | A | 6/1992 | Eubank et al. |
| 5,145,247 | A | 9/1992 | Mandy |
| 5,161,879 | A | 11/1992 | McDermott |
| 5,253,152 | A | 10/1993 | Yang et al. |
| 5,408,394 | A | 4/1995 | Mandy |
| 5,412,542 | A | 5/1995 | Mandy |
| 5,568,964 | A | 10/1996 | Parker et al. |
| 5,613,751 | A | 3/1997 | Parker et al. |
| 5,618,096 | A | 4/1997 | Parker et al. |
| 5,661,645 | A | 8/1997 | Hochstein |
| 5,739,639 | A | 4/1998 | Johnson |
| 5,850,126 | A | 12/1998 | Kanbar |
| 5,876,107 | A | 3/1999 | Parker et al. |
| 5,894,686 | A | 4/1999 | Parker et al. |
| 5,895,115 | A | 4/1999 | Parker et al. |
| 5,921,652 | A | 7/1999 | Parker et al. |
| 5,921,670 | A | 7/1999 | Shumacher et al. |
| 5,966,069 | A | 10/1999 | Zmurk et al. |
| 6,030,089 | A | 2/2000 | Parker et al. |
| 6,079,838 | A | 6/2000 | Parker et al. |
| 6,158,867 | A | 12/2000 | Parker et al. |
| 6,185,356 | B1 | 2/2001 | Parker et al. |
| 6,474,846 | B1 * | 11/2002 | Kelmelis ..... F21V 17/164 248/231.91 |
| 6,609,804 | B2 | 8/2003 | Nolan et al. |
| 6,712,481 | B2 | 3/2004 | Parker et al. |
| 6,752,505 | B2 | 6/2004 | Parker et al. |
| 6,764,196 | B2 | 7/2004 | Bailey |
| 6,827,456 | B2 | 12/2004 | Parker et al. |
| 6,860,628 | B2 | 3/2005 | Robertson et al. |
| 6,872,220 | B2 | 3/2005 | Williams et al. |
| 6,874,925 | B2 | 4/2005 | Page et al. |
| 6,994,457 | B2 | 2/2006 | Lee |
| 7,066,617 | B2 | 6/2006 | Mandy et al. |
| 7,071,625 | B2 | 7/2006 | Cheng et al. |
| 7,077,544 | B2 | 7/2006 | Parker |
| 7,114,829 | B2 | 10/2006 | Lai |
| 7,114,830 | B2 | 10/2006 | Robertson et al. |
| 7,246,926 | B2 | 7/2007 | Harwood |
| 7,261,453 | B2 | 8/2007 | Morejon et al. |
| 7,396,139 | B2 | 7/2008 | Savage |
| 7,486,033 | B2 | 2/2009 | Chen et al. |
| 7,722,227 | B2 | 5/2010 | Zhang et al. |
| 7,896,517 | B2 | 3/2011 | Mandy et al. |
| 8,092,035 | B2 | 1/2012 | Mandy et al. |
| 8,096,672 | B2 | 1/2012 | Mandy et al. |
| 8,558,407 | B2 | 10/2013 | Mandy et al. |
| 8,757,852 | B2 * | 6/2014 | Lopez ..... F21K 9/00 362/294 |
| 9,004,713 | B2 | 4/2015 | Mandy et al. |
| 2004/0125246 | A1 | 7/2004 | Okamori et al. |
| 2005/0190345 | A1 | 9/2005 | Dubin et al. |
| 2006/0038192 | A1 | 2/2006 | Williams |
| 2006/0187654 | A1 | 8/2006 | Jungel-Schmid et al. |
| 2007/0195532 | A1 | 8/2007 | Reisenauer |
| 2007/0242461 | A1 | 10/2007 | Reisenauer et al. |
| 2008/0024010 | A1 | 1/2008 | Romano |
| 2008/0084700 | A1 | 4/2008 | Van de Ven |
| 2008/0192489 | A1 | 8/2008 | Ward |
| 2008/0258628 | A1 | 10/2008 | Higley et al. |
| 2008/0296975 | A1 | 12/2008 | Shakespeare et al. |
| 2009/0290361 | A1 | 11/2009 | Ruud et al. |
| 2011/0044047 | A1 | 2/2011 | Mandy et al. |
| 2011/0299290 | A1 | 12/2011 | Mandy |
| 2012/0187852 | A1 | 7/2012 | Mandy et al. |

FOREIGN PATENT DOCUMENTS

| | | |
|---|---|---|
| WO | 2005098806 | 10/2005 |
| WO | 2006031350 A2 | 3/2006 |

OTHER PUBLICATIONS

Search Report from the Intellectual Property Office for German Application No. GB1204033.3, dated Jun. 14, 2012; 1 page.

* cited by examiner

DOWNWARD ILLUMINATION ASSEMBLY

This application claims the benefit of the filing date of U.S. Provisional Patent Application Ser. No. 61/787,387, filed Mar. 15, 2013; which is incorporated herein by reference in its entirety.

BACKGROUND

1. Field

This application relates generally to a downward illumination assembly for directing light downward from the ceiling area of a room such as an elevator passenger compartment.

2. Description of Related Art including information disclosed under 37 CFR 1.97 and 1.98 U.S. Pat. No. 7,896,517

Downward illumination assemblies that are designed to prevent access from below present maintenance problems because they increase the difficulty of removing and replacing lamps. Downward illumination assemblies that are designed to allow access from below allow for easy lamp replacement, but are susceptible to unauthorized access.

SUMMARY

An illumination assembly is provided for illuminating the interior of an elevator passenger compartment. The assembly comprises a lamp housing having a circumferential sidewall defining an opening at a lower end of the lamp housing in a position to direct light from the lamp housing downward through a hole in a ceiling panel when the lamp housing is carried by the ceiling panel in alignment with the ceiling panel hole. The assembly also comprises a lamp module comprising at least one lamp, the lamp module being supported within the lamp housing in a position to emit light from the lamp through the lamp housing opening when the lamp is energized, the lamp module being configured to be removable from the lamp housing from below the ceiling panel through the lamp housing opening and the hole in the ceiling panel, the lamp housing being configured to removably receive the lamp module into an installed position from which to direct light emitted from the lamp downward through the lamp housing opening. The assembly further comprises heat transfer ribs extending integrally and radially outward from the circumferential sidewall of the lamp housing at spaced locations around the lamp housing and configured to transfer to an ambient air mass, heat that has been generated by the lamp and conducted through the lamp module and the housing sidewall. The assembly also comprises bracket engagement surfaces standing radially outward from the circumferential sidewall of the lamp housing far enough to allow angle brackets to be secured against the respective bracket engagement surfaces by a band encircling the heat transfer ribs such that lower portions of the angle brackets extending radially outward from the lamp housing are positioned to engage and support the assembly on an upper surface of the ceiling panel surrounding the ceiling panel hole.

DRAWING DESCRIPTIONS

These and other features and advantages will become apparent to those skilled in the art in connection with the following detailed description and drawings of one or more embodiments of the invention, in which.

DETAILED DESCRIPTION

Figure 1:
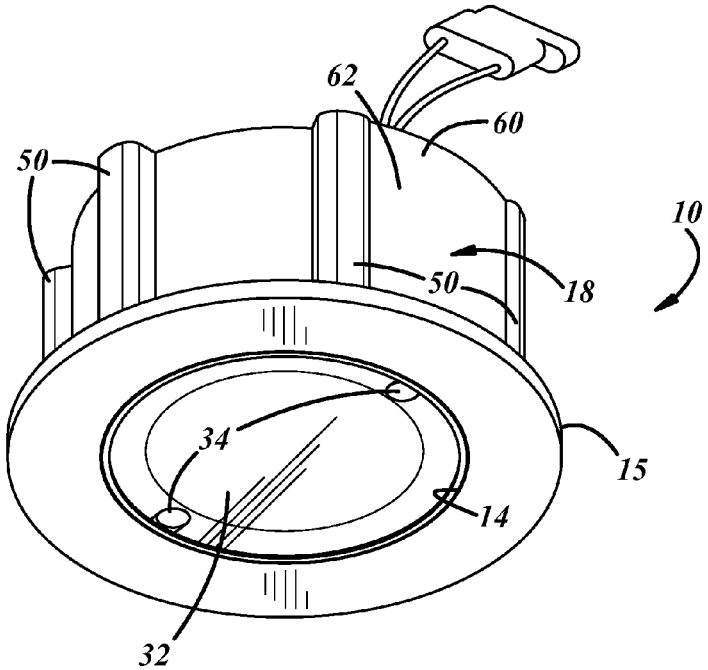
FIG. 1 is an isometric view of an embodiment of a downward illumination assembly.

A downward illumination assembly for directing light downward from the ceiling area of an elevator passenger compartment, is generally shown at 10 in FIGS. 1-6. The assembly 10 may comprise a lamp housing 12 having an opening 14 at a lower or front end of the housing, and a front flange 15 extending outward from around the opening 14 at the front end. 12. The lamp housing 12 may be configured to be mounted on a ceiling panel 16, as shown in FIGS. 3-6, in a position to direct light from a lamp, such as an LED or an OLED, downward through the housing opening 14 and through a hole 17 in the ceiling panel 16.

The assembly 10 may include a lamp module 18, which may comprise more than one lamp. The lamp module 18 may, for example, be an LED module comprising three lamps in the form of light-emitting diodes (LED). The lamp module 18 may be supported within the lamp housing 12 in a position to emit light from the housing 12 through the housing opening 14 when the lamp(s) are energized. The lamp module 18 may be configured to be removable from the lamp housing 12 from below the ceiling panel 16 through the housing opening 14 and the hole 17 in the ceiling panel 16 as best shown in FIG. 4.

Figure 6:
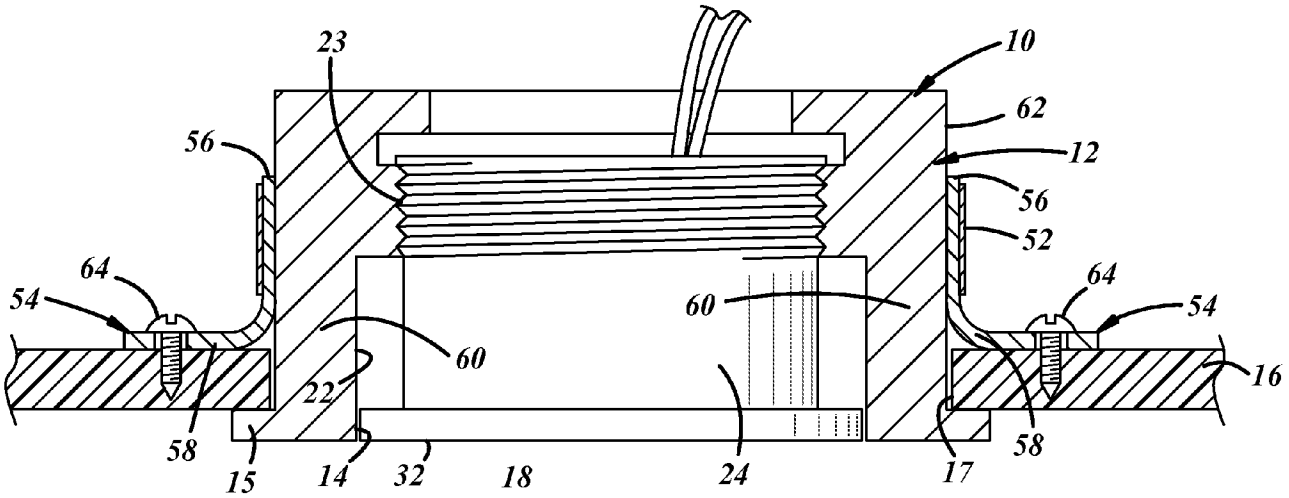
FIG. 6 is a partial cross-sectional front view of the assembly of FIG. 1 and the mounting hardware of FIGS. 2-5, shown mounted on a ceiling panel as shown in FIGS. 3 and 4.

The lamp housing 12 may be configured to removably receive the lamp module 18 and to support the lamp module 18 in a position to direct light emitted from the lamp(s) downward through the housing opening 14. As best shown in FIG. 6, threads 21 may be formed in an inner cylindrical wall 22 of the lamp housing 12 to receive threads 23 formed in an outer circumferential surface 24 of the lamp module 18 in threaded engagement.

Figure 4:
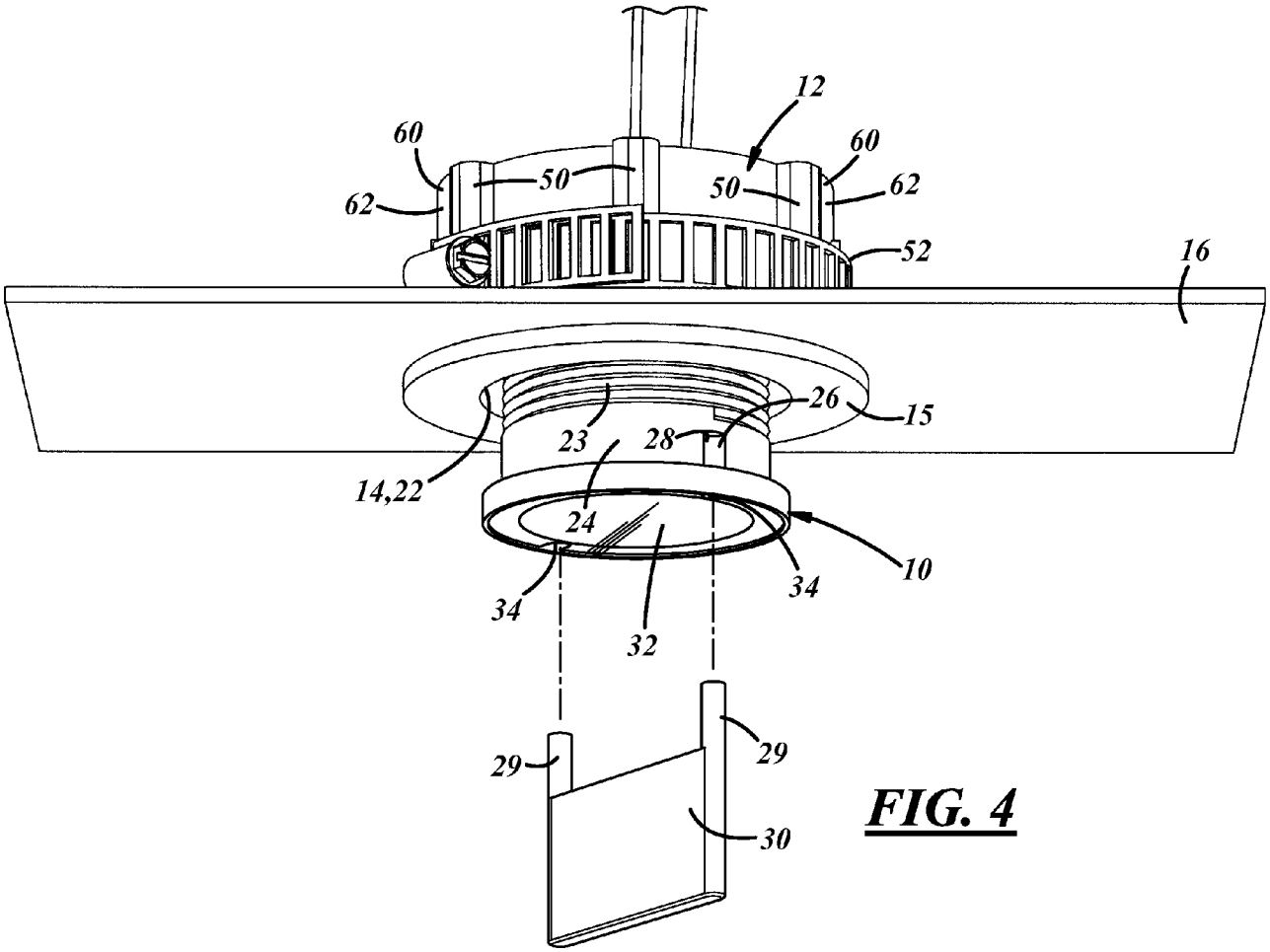
FIG. 4 is an isometric view of the assembly of FIG. 1 mounted on a ceiling panel with a lamp module of the assembly shown partially removed/inserted using an installation/removal tool.

As shown in FIG. 4, the lamp module 18 may also include at least two lamp module installation surfaces 26 and/or two lamp module removal surfaces 28 positioned to be engaged by respective engagement surfaces 29 of an installation/removal tool 30. As shown in FIG. 6, the tool 30 may be configured to apply torque to and rotate the lamp module 18 relative to the lamp housing 12.

As shown in FIG. 1, the lamp module 18 may comprise a circular lower surface 32. The lamp module lower surface may include two generally cylindrical recesses 34 disposed in the lower surface 32, which may be in diametrically-opposite locations relative to a rotational axis 36 of the lamp module 18. Preferably the recesses 34 may be disposed in diametrically-opposite locations at or adjacent a peripheral outer edge of the lower surface 32. Each of the two recesses 34 may comprise one of the lamp module removal surfaces 28 and one of the lamp module installation surfaces 26 disposed in respective inward-facing positions opposite one another in each recess 34.

The lamp module installation and removal surfaces 26, 28 in each of the two recesses 34 may be configured for engagement by respective outward facing engagement surfaces 29 of respective prongs 31 of the installation/removal tool 30. In other words, the tool 30 may have at least two prongs 31 configured and spaced for insertion into the two recesses 34 so that the application of torque to the tool 30 results in the application of torque and imparting of rotation to the lamp module 18 relative to the lamp housing 12.

In other embodiments, however, more than two recesses 34 or prongs 30 may be used, and the recesses and prongs may be of any shape capable of insertion into the recesses 34 and the application of torque to the lamp module 18 through engagement with the installation and removal surfaces 26, 28 within the recesses 34. Also, where the lamp module 18 includes more than two recesses configured to be engaged by a tool having more than two prongs, the recesses 34 need not be disposed in diametrically-opposite locations.

As best shown in FIG. 6, the assembly 10 may have a lower profile than known elevator ceiling light fixtures, such as, for example, the downward illumination assembly 10 disclosed in U.S. patent application Ser. No. 13/344,629 (the '629 application); which was filed Jan. 6, 2012, was published as US2012/0106138 A1, is assigned to the assignee of the present invention, and is incorporated herein, in its entirety, by reference. The height of the embodiment of the assembly 10 shown in the drawings, for example, is only 1.28 inches, compared to the 2.625 inch height of the downward illumination assembly disclosed in the '629 application.

Figure 5:
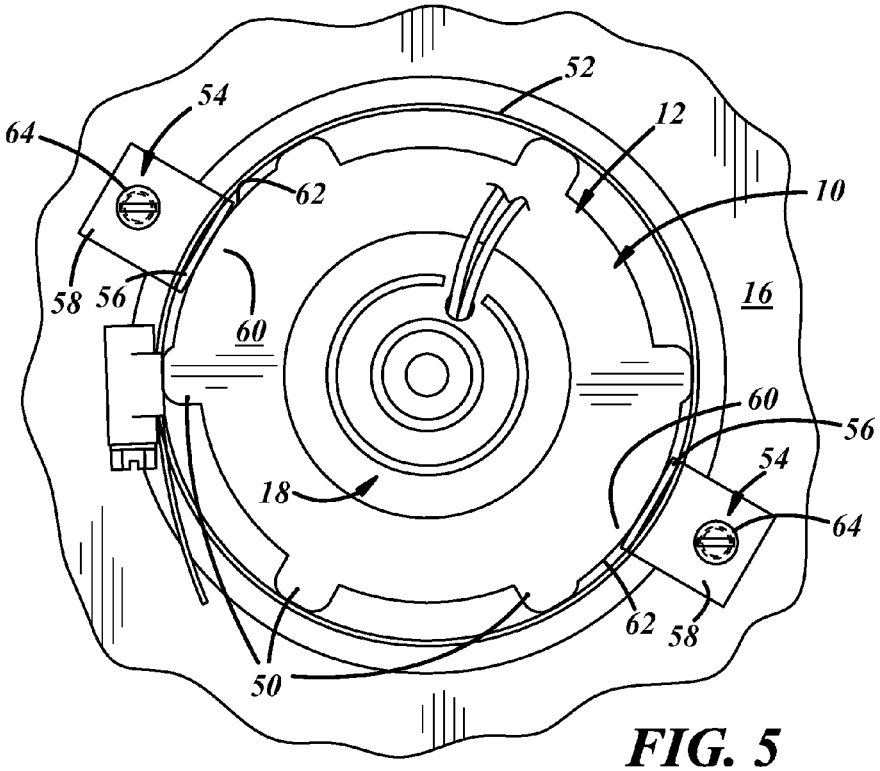
FIG. 5 is a top view of the assembly of FIG. 1 mounted on a ceiling panel as shown in FIG. 4.
Figure 2:
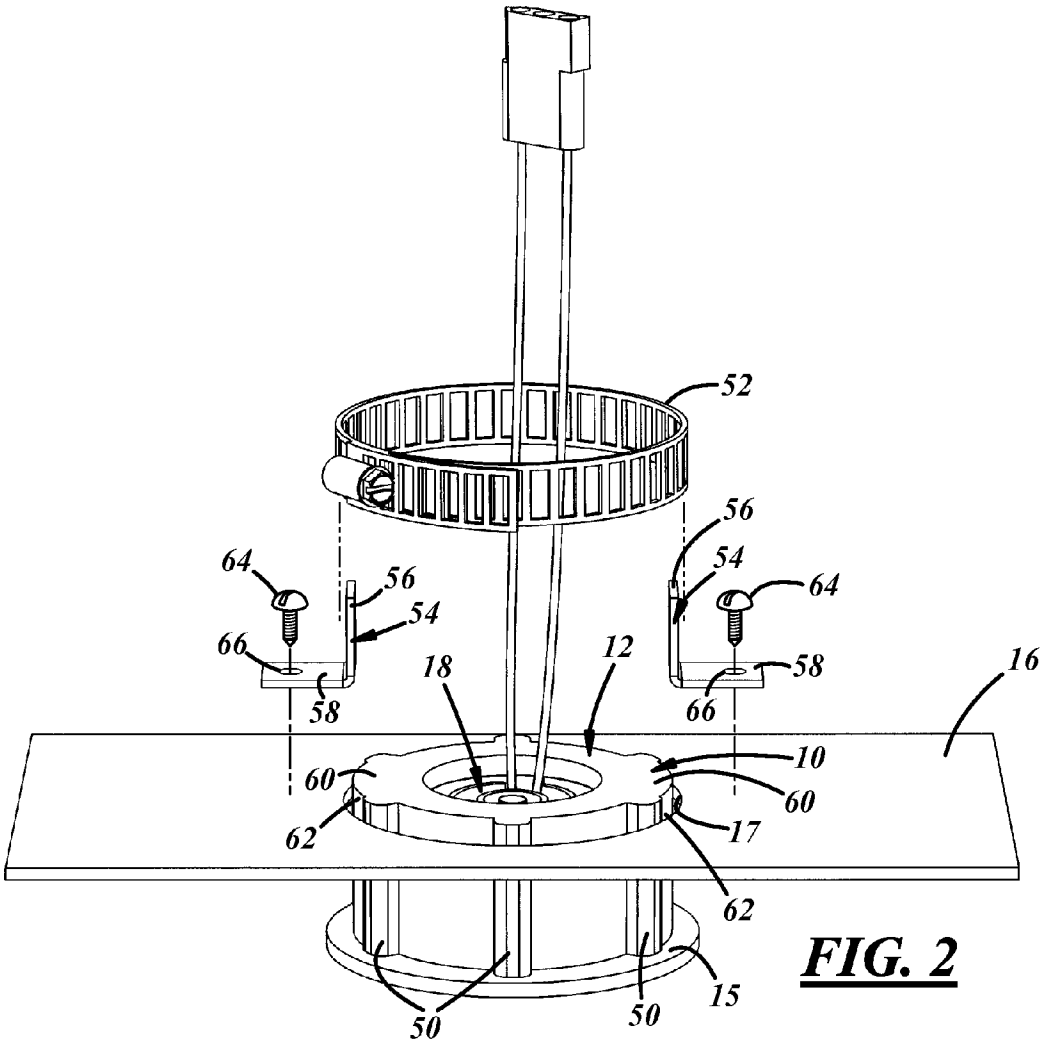
FIG. 2 is an isometric view of the assembly of FIG. 1 partially inserted into a ceiling panel hole with mounting hardware, comprising L-brackets and a hose clamp, shown exploded upwards.
Figure 3:
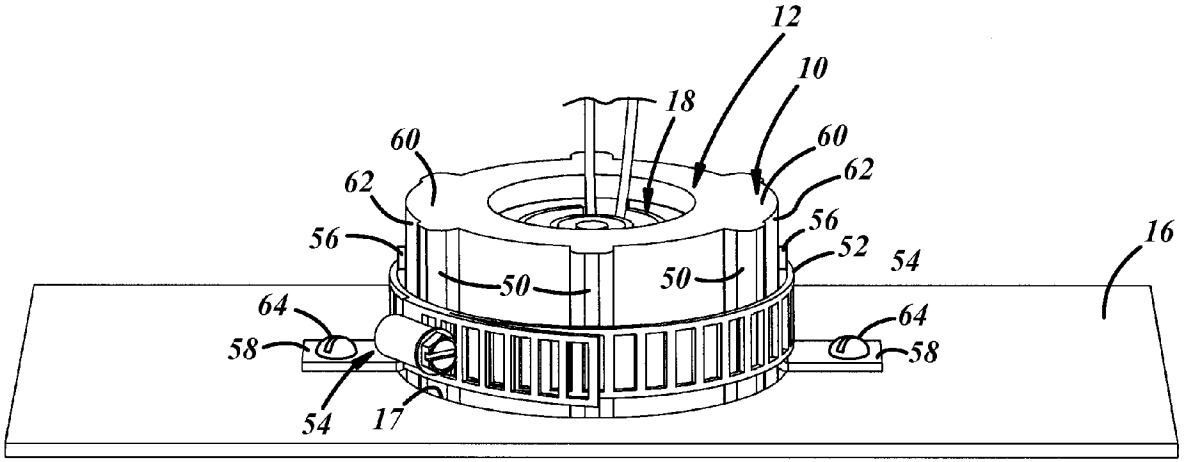
FIG. 3 is an isometric view of the assembly of FIG. 1 mounted on a ceiling panel using the L-brackets and hose clamp of FIG. 2.

Despite the low-profile configuration of the assembly 10, its lamp module 18 is capable of providing the same or similar light output as known elevator ceiling light fixtures, such as the light output of the LED module of the assembly disclosed in the '629 application, without overheating. This is because the assembly 10 provides for increased convective heat transfer by including generally vertically-oriented ribs 50 that, as best shown in FIG. 5, extend integrally and radially outward from spaced locations around the outer circumferential surface 24 of the lamp housing 12, and by including a relatively large front flange 15. The front flange 15 of the lamp housing 12 may, for example, measure 0.500 inches in radial width compared to the 0.250 inch radial width of the front flange 15 of the lamp housing disclosed in the '629 application. The ribs 50 and lamp housing 12 may also be configured to allow the assembly 10 to fit within the same 2¾ inch diameter ceiling panel hole 17 as the assembly disclosed in the '629 application, while still providing sufficient surface area to effect the necessary convective heat transfer.

As shown in FIGS. 3-6, the assembly 10 may be mounted in an elevator ceiling panel hole 17 using a hose clamp 52 and at least two L-brackets 54, with a vertical portion 56 of each L-bracket 54 clamped against the lamp housing 12 of the fixture by the hose clamp 52, and a horizontal portion 58 of each L-bracket extending radially outward from the lamp housing 12 to rest on an upper surface of a ceiling panel 16 adjacent the ceiling panel hole 17. Because the hose clamp 52 in this mounting arrangement would engage radial outer edges of the ribs 50 rather than L-brackets 54 positioned against the outer circumferential surface 24 of the lamp housing 12, the lamp housing 12 includes bracket supports 60 integrally formed into the lamp housing 12 in two diametrically opposite locations to provide respective bracket engagement surfaces 62 against which the hose clamp 52 can firmly bind the vertical portions 56 of the L-brackets 54. The bracket supports 60 may be integrally formed with the lamp housing 12 as a single unitary piece by casting any suitable material. To provide improved conductive heat transfer from the lamps to the ribs 50, both the lamp module 18 and the lamp housing 12 may comprise metal.

The lamp housing 12 may be installed in a ceiling panel hole 17 by inserting the lamp housing 12 into the ceiling panel hole 17 from below until the front flange 15 engages a lower surface of the ceiling panel 16. The vertical portions 56 of the L-brackets 54 may then be clamped against the bracket support surfaces 62 of the lamp housing 12 with the horizontal portions 58 of the L-brackets 54 resting on the upper surface of the ceiling panel 16. To resist rotation of the lamp housing 12 when the lamp module 18 is being screwed into the lamp housing 12, a fastener 64 may be passed through a hole 66 in the horizontal portion 58 of at least one of the L-brackets 54 and into the ceiling panel 16.

The lamp module 18 of the illumination assembly 10 may be installed within the lamp housing 12 by first by axially inserting the lamp module 18 into the lamp housing 12 by passing the lamp module 18 upward through the ceiling panel hole 17 and the housing opening 14. The lamp module 18 may then be rotated relative to the lamp housing 12 such that the module detent 38 engages the housing detent 40 in such a way as to resist axial separation of the lamp module 18 from the lamp housing 12. Where the module and housing detents 38, 40 comprise generally cylindrical, complementary threaded surfaces 39, the lamp module 18 may be rotated so as to thread the lamp module 18 into the lamp housing 12 until the lamp module 18 reaches a fully installed position within the lamp housing 12.

To remove the lamp module 18 from the lamp housing 12, the lamp module 18 may be rotated relative to the lamp housing 12 such that the module detent 38 disengages from the housing detent 40 in such a way as to allow axial separation of the lamp module 18 from the lamp housing 12. Where the module and housing detents 38, 40 comprise generally cylindrical, complementary threaded surfaces 39, the lamp module 18 may be rotated so as to unthread the lamp module 18 from the lamp housing 12.

Lamp module installation and/or removal may include the use of the installation/removal tool 30 to engage the lamp module installation surfaces 26 and/or lamp module removal surfaces 28 and to apply torque to rotate the lamp module 18 relative to the lamp housing 12. In other words, the tool 30 may be used to rotate the lamp module 18 to either further secure the lamp module 18 to the lamp housing 12, or remove the lamp module 18 from an installed position within the housing 12 by threading or unthreading the threads 39.

A downward illumination assembly constructed as described above allows easy removal for repair or replacement of a lamp module 18 without any need to access the assembly from above, or to remove the entire assembly from a ceiling. Since the lamp module cannot be removed without a compatible tool, the assembly is resistant to unauthorized removal. In addition, the low profile of the assembly allows it to be installed in elevators having drop ceilings that are in close proximity to their canopies, leaving very little vertical space for the installation of downward illumination assemblies, and even less vertical space for elevator ceiling escape hatch door panels that, in an emergency, must have room to be slid sideways between the drop ceiling and the canopy. The low profile of the assembly makes it easier for elevator designers to incorporate structures that guide escape hatch door panels over or on top of one or more of the downward illumination assemblies.

This description, rather than describing limitations of an invention, only illustrates an embodiment of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. An illumination assembly for illuminating the interior of an elevator passenger compartment, the assembly comprising:

a lamp housing having a circumferential sidewall defining an opening at a lower end of the lamp housing in a position to direct light from the lamp housing downward through a hole in a ceiling panel when the lamp housing is carried by the ceiling panel in alignment with the ceiling panel hole;

a lamp module comprising at least one lamp, the lamp module being supported within the lamp housing in a position to emit light from the lamp through the lamp housing opening when the lamp is energized, the lamp module being configured to be removable from the lamp housing from below the ceiling panel through the lamp housing opening and the hole in the ceiling panel, the lamp housing being configured to removably receive the lamp module into an installed position from which to direct light emitted from the lamp downward through the lamp housing opening;

heat transfer ribs extending integrally and radially outward from the circumferential sidewall of the lamp housing at spaced locations around the lamp housing and configured to transfer to an ambient air mass, heat that has been generated by the lamp and conducted through the lamp module and the housing sidewall;

wherein the lamp housing comprises bracket engagement surfaces standing radially outward from the circumferential sidewall of the lamp housing; and angle brackets securable against the respective bracket engagement surfaces by a band encircling the heat transfer ribs such that lower portions of the angle brackets extending radially outward from the lamp housing are positioned to engage and support the assembly on an upper surface of the ceiling panel surrounding the ceiling panel hole.

2. An illumination assembly as defined in claim 1 in which the lamp comprises a light-emitting diode (LED) and the lamp module is an LED module.

3. An illumination assembly as defined in claim 1 in which the bracket support surfaces are disposed on bracket supports that extend integrally and radially outward from the circumferential sidewall of the lamp housing.

4. An illumination assembly as defined in claim 3 in which the bracket supports are integrally formed with the circumferential sidewall of the lamp housing as a single unitary piece.

5. An illumination assembly as defined in claim 1 in which the bracket supports are disposed in diametrically opposite locations around the circumferential sidewall of the lamp housing.

6. An illumination assembly as defined in claim 1 in which:

the angle brackets are L-brackets; and the bracket engagement surfaces are positioned and shaped to engage and support vertical portions of the L-brackets in respective positions where the band encircling the ribs is able to firmly bind the vertical portions of the L-brackets against the respective bracket engagement surfaces with horizontal portions of the L-brackets extending radially outward from the lamp housing a sufficient distance to engage an upper surface of a ceiling panel upon which the assembly is to be supported.

7. An illumination assembly as defined in claim 1 in which the heat transfer ribs are elongated and oriented axially.

8. An illumination assembly as defined in claim 1 in which:

the circumferential sidewall of the lamp housing is generally cylindrical; and the ribs and bracket supports extend integrally and radially outward from the lamp housing sidewall at spaced locations around the circumferential sidewall of the lamp housing.

9. An illumination assembly as defined in claim 1 in which the ribs are formed with the circumferential sidewall of the lamp housing as a single unitary piece.

10. An illumination assembly as defined in claim 1 in which:

the assembly includes a front flange extending outward from around the opening at the lower end of the lamp housing to engage a portion of a ceiling panel lower surface surrounding the ceiling panel hole; and the front flange and the angle brackets cooperate in axial opposition to secure the assembly to the ceiling panel.

11. An illumination assembly as defined in claim 10 in which the front flange and the angle brackets cooperate in resisting rotation of the lamp housing relative to the ceiling panel.

12. An illumination assembly as defined in claim 1 in which threads are formed in an inner cylindrical wall of the lamp housing to receive threads formed in an outer circumferential surface of the lamp module in threaded engagement, the lamp module including at least two lamp module removal surfaces positioned to be engaged by respective engagement surfaces of a tool configured to apply torque to and rotate the lamp module relative to the lamp housing.

13. An illumination assembly as defined in claim 12 in which the lamp module comprises a circular lower surface including two or more recesses located on diametrically-opposite sides of the lamp module circular lower surface.

14. An illumination assembly as defined in claim 13 in which each of the two recesses comprises one of the lamp module removal surfaces and one of the lamp module installation surfaces disposed in respective inward-facing positions opposite one another in each recess for engagement by respective outward facing engagement surfaces of a prong of an installation/removal tool having two or more prongs configured to be inserted in the two or more recesses to apply torque and impart rotation to the lamp module relative to the lamp housing.

* * * * *